United States Patent [19]

Stoop

[11] Patent Number: 4,573,233

[45] Date of Patent: Mar. 4, 1986

[54] PAINT ROLLER ASSEMBLY FOR PAINTING CHAIN LINK FENCES AND SIMILAR STRUCTURES

[76] Inventor: Charles W. Stoop, 1598 NE. 172 St., North Miami Beach, Fla. 33162

[21] Appl. No.: 687,721

[22] Filed: Dec. 31, 1984

[51] Int. Cl.[4] ..... B05C 1/08

[52] U.S. Cl. ..... 15/230.11; 15/230.14

[58] Field of Search ..... 15/230.11, 230.14

[56] References Cited

U.S. PATENT DOCUMENTS

| | | | |
|---|---|---|---|
| 2,735,128 | 2/1956 | Adams | 15/230.11 |
| 2,761,167 | 9/1956 | Bridgford | 15/230.11 X |
| 2,866,995 | 1/1959 | Evensen | 15/230.11 |
| 2,904,813 | 9/1959 | Schleicher | 15/230.11 |
| 3,008,167 | 11/1961 | Pharris et al. | 15/230.11 |
| 3,448,479 | 6/1969 | Cadematori | 15/230.11 |

*Primary Examiner*—Chris K. Moore

*Attorney, Agent, or Firm*—John Cyril Malloy

[57] ABSTRACT

A paint roller assembly primarily designed to paint a chain link fence or like structure formed from interengaging wire or like material strands. A paint roller is rotatably mounted on a frame-type handle and includes a base cover and a plurality of spaced apart segments formed of a flexible, resilient porous material wherein a seam is formed between adjacently positioned segments. The seam has an annular configuration of continuous length serving to at least partially separate adjacent segments and each seam includes an interior surface dimensioned and configured for disposition in surrounding and engageable relation with a wire strand passing within the seam such that paint is transferred to all sides of the wire strand thereby necessitating the painting of only one side of the chain link fence.

14 Claims, 4 Drawing Figures

PAINT ROLLER ASSEMBLY FOR PAINTING CHAIN LINK FENCES AND SIMILAR STRUCTURES

BACKGROUND OF THE INVENTION

1. Field of the Invention

The present invention is directed towards a paint roller assembly structured for the painting of a chain link fence or like structure formed of inter-engaging wire strands wherein the structural configuration of the roller cover is such as to accomplish substantially surrounding engagement of the roller with each of the wire strands defining the chain link structure and thereby requiring the painting of only one side of the chain link fence or like structure.

2. Description of the Prior Art

In the painting industry the use of the hand-held roller is extremely popular and has certain major advantages over utilizing conventional brushes. The advantages of utilization of a roller is particularly recognized when painting a large substantially flat surface area such as walls or ceilings. The use of the brush is more advantageous for use in painting intricate structures or hard to reach locations involving corners, surface junctions, crevices, etc. Generally speaking, the roller assembly is faster and provides an even distribution of the paint over the surface being covered.

The paint roller has enjoyed such wide acceptance that attempts have been made in the prior art to structurally modify the conventional roller assembly in order to overcome certain of its generally recognized disadvantages. More specifically, paint rollers have been developed which include texturized outer surface covering wherein a pattern or texturized appearance can be painted on a given surface area. Prior art paint roller structures of this type are disclosed in the U.S. patent to Jannsen, U.S. Pat. No. 4,191,792. Similarly, the U.S. patent to Schulze, U.S. Pat. No. 3,274,637 is specifically structured to paint large surface areas such as walls or ceilings while at the same time is specifically structured to reach generally hard to paint locations such as corners or junctions.

Despite the advances made in th prior art paint roller structures, it is still apparent that there are certain applications for which a paint roller is less than totally efficient. Such structures include a chain link fence or similar structure formed from inter-engaging strands of wire or like material. While such a chain link structure is capable of being painted by what may be considered conventional paint roller assemblies, such a painting process is generally considered to be inefficient due to the waste of paint and the necessity of repeatedly covering portions of the chain link structure defined by the irregularly displaced and overlapping and inter-engaging wire strands.

In an attempt to overcome such problems, the prior art was advanced by the invention disclosed in the U.S. patent to Evensen, U.S. Pat. No. 2,866,995, directed to a paint roller for woven wire fences. The Evensen structure while apparently operable for the intended application is formed in part from a material which may have questionable coating characteristics in terms of coating the entire exterior surface of the individual wire strand forming the chain link structure especially when applying the roller to only one side of the chain link structure or fence.

Accordingly, there is still a need in the prior art relating to paint roller assemblies for a preferred paint roller assembly capable of efficiently and effectively painting chain ink fences by coating the irregular disposed and interengaging wire strands by applying the paint bearing roller to only a single side thereof and further wherein such a preferred paint roller structure is formed from a material capable of retaining paint and subsequently transferring the paint to the chain link structure in an efficient manner. Further, the preferred paint roller assembly should be capable of being disassembled and removed from the roller base such that the size of various components comprising the roller assembly may be adjusted and the entire roller assembly can be readily cleaned.

SUMMARY OF THE INVENTION

The present invention is directed towards a paint roller assembly primarily designed for the painting of a chain link fence or like material structure which is generally formed from a plurality of interengaging and intermeshing wire strands collectively arranged in a sheet-like configuration. More specifically, the paint roller assembly of the present invention comprises a roller base rotatably mounted on a frame-like handle which serves to support the base as well as the remainder of the paint roller secured to the base, in a position for application of paint to the roller and transfer of the retained paint onto a given surface or structure being painted.

A roller cover assembly is provided which comprises a base cover having a substantially elongated hollow tubular configuration of a length substantially equal to the base of the roller and disposable in removable but covering relation thereto. The base cover frictionally engages the exterior surface of the base so as to rotate therewith during engagement of the paint roller to the surface being painted.

The cover roller assembly further includes a plurality of segments mounted on and extending outwardly from the exterior surface of the base cover. The segments are successively arranged along the length of the base cover in at least partially separated relation to one another. Separation between the individual segments is accomplished through the provision of a seam having an annular configuration so as to extend completely around the base cover and separate the individual segments along their entire continuous length.

An important feature of the present invention is the dimensioning and configuration of the cross-section of each seam such that a wire strand entering each of the seams is substantially surrounded by the interior surface of the seam such that the entire exterior surface of each strand is engaged by an interior, exposed surface portion of the seam. This construction and application of paint to the entire exterior surface of each strand eliminates the need for painting a chain link fence on opposite sides. Time and labor is thereby saved since the subject paint roller assembly need be applied only to one side of any such chain link material structure.

In order to accomplish efficient and effective transfer of paint to the entire exposed surface area of each wire strand, each of the seams and more specifically the interior surface defining the seams may be at least partially defined by an undercut portion integrally formed in the annular peripheral edge of at least one of the adjacently positioned segments. The remainder of the interior portion of each seam may be defined by a base comprising the exterior surface of the base cover and the correspondingly disposed peripheral edge of the other adjacent segment which a given seam serves to separate.

Total surrounding engagement of each of the wire strands is further insured through the provision of an entrance portion of each seam extending along the length thereof and having a transverse dimension substantially equal to but somewhat less than the transverse dimension of the wire strand entering the seam. Conversely, the transverse dimension of the undercut portion is substantially greater than that of the entrance or the wire strand in order to insure that the wire strand will be completely surrounded upon entering the seam.

The invention accordingly comprises the features of constructions, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference characters refer to like parts throughout the several views of the drawings.

DETAILED DESCRIPTION OF THE PREFERRED EMBODIMENT

Figure 2:
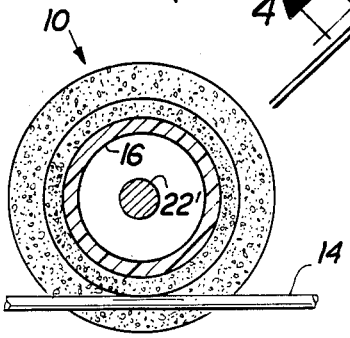
FIG. 2 is a sectional view taken along line 2—2 of FIG. 1 showing structural details of the components of the subject paint roller assembly.
Figure 3:
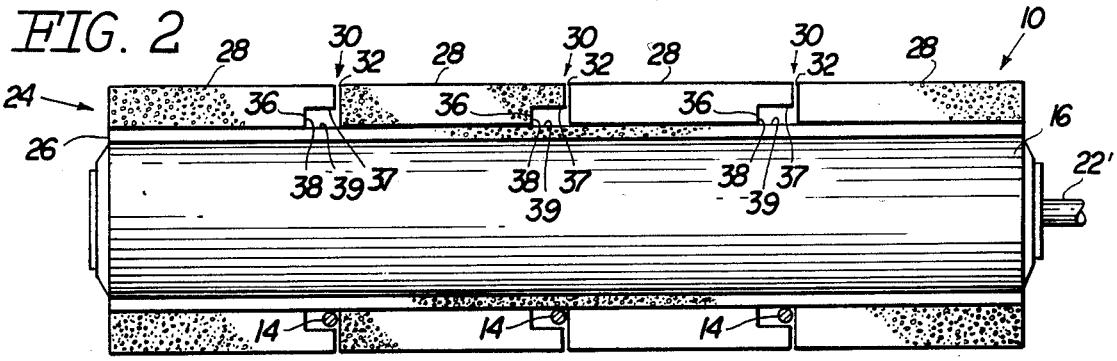
FIG. 3 is a longitudinal sectional view along line 3—3 of FIG. 1 showing one embodiment of the subject paint roller assembly.
Figure 4:
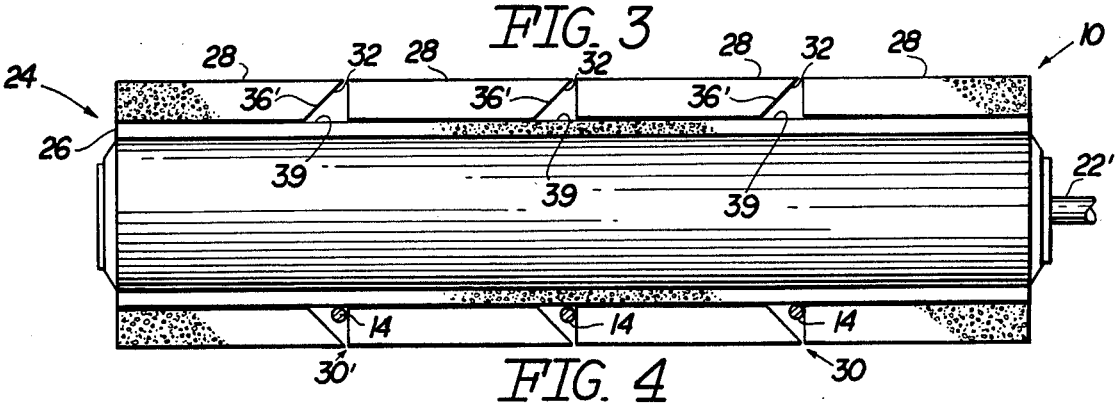
FIG. 4 is a longitudinal sectional view along line 4—4 of FIG. 1 showing structural features of yet another embodiment of the paint roller assembly of the present invention.

The present invention is directed towards a paint roller assembly generally indicated as 10 primarily designed to paint a chain link fence or like structure generally indicated as 12 formed from a plurality of wire or like material strands 14 disposed in interconnecting and substantially overlapping engagement with one another. The paint roller assembly 10 comprises a base 16 having a substantially cylindrical configuration and being rotatably mounted on a frame-type handle generally indicated as 18. The handle 18 may take any number of a variety of configurations and include a hand-gripping portion 20 and an outwardly extending supporting arm 22. The base 16 is rotatably mounted on the distal end of the frame 22 as at 22' (FIGS. 2, 3 and 4). The end portion 22' extends coaxially the length of the base 16 (FIG. 2) and is secured to the base, in a manner well known in the prior art, such that the base 16 rotates thereabout.

The paint roller assembly of the present invention comprises a roller cover assembly generally indicated as 24 which includes an elongated tubular, substantially sleeve-like base cover 26 extending along the length of base 16 and in covering relation thereto. The base 26 may be removably mounted on the base 16 for removal and cleaning thereof but frictionally or otherwise engages the exterior surface of base 16 so as to rotate therewith.

The roller cover assembly 24 of the present invention further comprises a plurality of segments 28 each having an annular configuration of continuous length and disposed in surrounding relation and extending outwardly from the base cover 26 in the manner clearly shown in FIGS. 3 and 4. Each of the segments 28 may be removable from the base cover 26 or alternately affixed or integrally secured thereto wherein in either structure, the individual segments 28 rotate with the base cover 26 and base 16 upon engaging of a surface to be painted in the conventional fashion.

The plurality of segments 28 extend successively along the length of the base cover 26 and base 16 in spaced apart relation to one another. The spacing between the individual segments is established through the provision of a plurality of individual seams 30 each having an annular configuration and disposed in surrounding relation to the base cover 26 so as to separate adjacently positioned segments 28 along their continuous length. Each seam 30 (and 30' in the embodiment of FIG. 4) includes an entrance 32 which preferably has a transverse dimension substantially equal to but somewhat less than each of the wire strands 14. This particular transverse dimension insures engagement between the exposed surfaces of the entrance portion 32 of each seam 30 and paint transferring contact of the adjacent segments with the correspondingly positioned wire strands 14.

As clearly represented in FIGS. 3 and 4, each of the seams 30, 30' is defined in part by correspondingly positioned peripheral edges of adjacently disposed segments 28. Further, the inner or exposed surface of each seam, along the entire length thereof, is further defined by an undercut portion 36 (FIG. 1) and 36' (FIG. 3) and 36' (FIG. 4).

With regard to the embodiment of FIG. 3, the undercut portion is defined by a substantially stepped cross-sectional configuration comprising perpendicularly oriented surfaces 37 and 38. Therefore, the transverse dimension of the undercut portion 36 is substantially greater than the transverse dimension of the entrance portion 32 or the corresponding dimension of the wire strand 14. Such cutout portion and increased transverse dimension serves to totally surround the exposed surface of each wire strand with a paint-bearing interior surface of the seam 30. Further, each of the seams 30 includes a base 39 defined by an exposed surface portion of base cover 26.

In the embodiment of FIG. 4, the cutout portion 36' is defined by a straight line cross-sectional configuration extending divergently from the entrance 32 of each seam 30' to the base 39. Again, the wire strand 14 is disposed in substantially surrounded engagement relative to the interior surface portions of each seam 30' and each of these inner surface portions of the seam 30 and 30' are paint-bearing surfaces which transfer such paint to the exterior surface of each of the wire strands.

By virtue of the above set forth construction, the roller assembly 10 need be applied to only one side of the chain link fence 12 in order to paint the entire exterior surface of each of the wire strand thereby giving the overall chain link structure 12 the appearance of having been painted from both sides.

Figure 1:
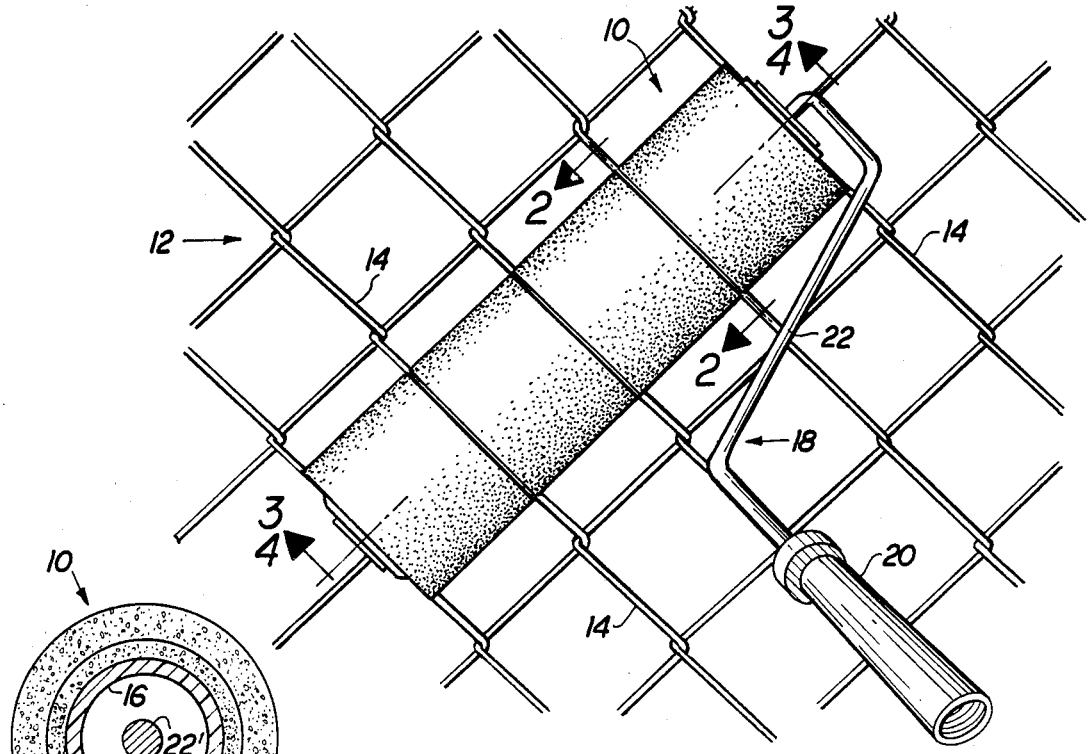
FIG. 1 is an isometric view in partial cutaway showing application of the paint roller to one side of a chain link fence or like structure.

In operation, it can be seen that the roller assembly 10 is placed on the chain link fence 12 such that the individual wire strands 14 are placed in the seam 30 (and/or 30'). However, a close examination of FIG. 1 shows that each of the successive strands 14 have their links offset a slight amount in that none of the successive wire strands 14, for example determining a diagonal distance on the chain link material 12, are disposed in true coaxial relation to one another. This offset relation of each of the successively disposed wire strands requires a somewhat lateral bearing force to be applied to the roller assembly, by the operator thereof in the direction of the lateral offset of the successive wire strands in order to keep the successive wire strands within the seams 30 (or 30') during a stroke or passage of the roller assembly 10. Such lateral force is minimal at best and is provided primarily to effect more efficient operation of the roller assembly such that the plurality of segments are disposed in surrounding disposition to the individual wire strands 14 comprising the chain link structure 12.

An additional feature of the present invention is the formation of both the base cover 26 and the individual segments 30 and 30' from a flexible, resilient, porous material commercially available and conventionally used as filter material for air conditioning and like facilities. It has been found, though experimentation, that that enlarged porous side of such material enables efficient paint retention and transfer while at the same time minimizing cleaning requirements while maintaining flexibility and operable life of the material over extended periods.

What is claimed is:

1. A paint roller assembly of the type primarily designed to paint a chain link structure formed of interengaging wire strands, said roller assembly comprising:

(a) a base having a substantially cylindrical configuration and rotatably mounted on a handle means extending outwardly from said base in supporting relation thereto for positioning said base during painting, (b) a roller cover assembly mounted on an outer surface of said base in covering relation thereto and secured to said base so as to rotate therewith, (c) said roller cover assembly comprising a base cover having an elongated, tubular configuration and mounted on said base in surrounding relation thereto and extending the length thereof, (d) said roller cover assembly further comprising a plurality of roller segments each having an annular configuration of continuous length and being disposed in successively adjacent, spaced relation to one another and in surrounding, outwardly extending relation to said base cover, (e) a plurality of seams each disposed between two adjacently positioned segments and at least partially defined by correspondingly disposed peripheral edges of said adjacently positioned segments, (f) each of said seams having an annular configuration and each being further defined by an undercut portion integrally formed on at least one of said peripheral edges defining each seam, and (g) each of said seams comprising an interior surface dimensioned and configured for disposition in substantially surrounding and engageable relation to wire strands entering said seams.

2. A paint roller assembly as in claim 1 wherein said interior surface of each of said seams is at least partially defined by correspondingly positioned exposed surface portions of said undercut portion and said peripheral edges of said adjacently positioned segments.

3. A paint roller assembly as in claim 2 wherein said interior surface of each of said seams further comprises an exposed surface portion of said base cover, the latter disposed to define a base portion of said respective seam.

4. A paint roller assembly as in claim 3 wherein each of said seams comprises an entrance portion extending the length thereof and having a transverse dimension substantially less than that of said undercut portion.

5. A paint assembly as in claim 4 wherein said undercut portion of at least one of said segments comprises an exposed surface having a substantially stepped crosssectional configuration including perpendicularly oriented surfaces extending inwardly from said entrance to said base on one interior side of said one seam.

6. A paint roller assembly as in claim 4 wherein said undercut portion of at least one of said segments comprises an exposed surface having a straight line crosssectional configuration angularly oriented to extend divergently inward from said entrance to said base on one interior side of said seam.

7. A paint roller assembly as in claim 4 wherein said transverse dimension of said entrance is substantially equal to a transverse dimension of a wire strand from which the chain link structure is formed.

8. A paint roller assembly as in claim 1 wherein said undercut portion of at least one of said segments comprises an exposed surface having a substantially stepped crosssectional configuration including perpendicularly oriented surfaces.

9. A paint roller assembly as in claim 1 wherein said undercut portion of at least one of said segments comprises an exposed surface having a straight line crosssectional configuration angularly oriented to extend divergently inward into said seam.

10. A paint roller assembly as in claim 1 wherein said base cover is removably mounted on and frictionally engages the exterior surface of said base so as to rotate therewith.

11. A paint roller assembly as in claim 10 wherein each of said segments comprises a width substantially equal to the distance between spaced apart and parallel oriented wire strands forming the chain link structure.

12. A paint roller assembly as in claim 11 wherein each of said segments are fixedly attached to said base cover.

13. A paint roller assembly as in claim 11 wherein each of said segments are removably mounted on said base cover in frictional engagement with the outer surface thereof so as to rotate therewith.

14. A paint roller assembly as in claim 1 wherein said base cover and said plurality of segments are formed from a flexible, resilient and porous material capable of retaining paint therein and subsequently transferring paint therefrom upon contact with the chain link structure.

* * * * *